United States Patent [19]

Igarashi

[11] Patent Number: 5,063,474

[45] Date of Patent: Nov. 5, 1991

[54] APPARATUS FOR, AND METHOD OF, DISCHARGING STATIC ELECTRICITY IN A DISPLAY AND PUSH-BUTTON SWITCH

[75] Inventor: Ken Igarashi, Saitama, Japan

[73] Assignee: Pioneer Electronic Corporation, Tokyo, Japan

[21] Appl. No.: 360,632

[22] Filed: Jun. 2, 1989

[30] Foreign Application Priority Data

Jun. 29, 1988 [JP] Japan ..... 63-87403[U]

[51] Int. Cl.[5] ..... H05F 3/02

[52] U.S. Cl. ..... 361/220; 361/212; 200/305

[58] Field of Search ..... 361/212, 220, 222, 380, 361/395; 200/304, 305, 341, 345; 174/5 R, 5 G, 51; 340/766, 773, 782, 784; 116/202; 206/45.31, 45.34, 328; 250/239, 552

[56] References Cited

U.S. PATENT DOCUMENTS

| | | | |
|---|---|---|---|
| 4,303,960 | 12/1981 | Sherwood et al. | 361/212 |
| 4,456,800 | 6/1984 | Holland | 200/5 A |
| 4,494,651 | 1/1985 | Malcolm | 361/212 X |
| 4,737,883 | 4/1988 | Hausler | 361/220 |
| 4,771,139 | 9/1988 | DeSmet | 200/5 A |
| 4,814,566 | 3/1989 | Sigl | 200/305 |

FOREIGN PATENT DOCUMENTS

| | | | |
|---|---|---|---|
| 2081184 | 2/1982 | United Kingdom | 200/305 |

*Primary Examiner*—A. D. Pellinen
*Assistant Examiner*—David Osborn
*Attorney, Agent, or Firm*—Sughrue, Mion, Zinn, Macpeak & Seas

[57] ABSTRACT

A static electricity discharging device used in a switch for an electrical equipment includes a push button movable into and out of an operative position so as to operate the switch of the electrical equipment, and an elastic member normally maintaining the push button out of the operative position, the elastic member being elastically deformable by the push button when the push button is moved to the operative position. The static electricity discharging device also includes an electrically-conductive layer disposed on a surface of the elastic member, the electrically-conductive layer being electrically grounded whereby external static electricity applied to the push button is passed directly to the ground through the electrically-conductive layer.

7 Claims, 3 Drawing Sheets

APPARATUS FOR, AND METHOD OF, DISCHARGING STATIC ELECTRICITY IN A DISPLAY AND PUSH-BUTTON SWITCH

BACKGROUND OF THE INVENTION

1. Field of the Invention

This invention relates to a device for protecting electrical circuits against static electricity and more particularly to a static electricity discharging device for use in a switch operating device for electrical equipment such as audio equipment.

2. Background

For example, many switches are used in electrical equipment such as audio equipment, such as amplifiers and tape decks. Such switches are operated by respective push buttons mounted on a front panel of the equipment.

One conventional switch operating device shown in FIG. 1 comprises a push button 2 extending outwardly of a front panel 1 through an aperture 1A formed therethrough, the front panel 1 and the push button 2 being made of plastic. A rear portion 2A of the push button 2 extends through an elastic member 3 made of a cushioning material such as sponge which is disposed between a flange 2B of the push button 2 and a frame wall 7. The flange 2B of the button 2 defines the height of a portion of the push button 2, which projects the front panel 1. The elastic force of the elastic member 3 is supplied to the button 2 through the flange 2B so that the button 2 returns to an original position immediately after it is pushed. The rear portion 2A of the push button 2 is held in contact with an actuator projection 5A of a switch 5, the switch 5 being mounted on a printed circuit board 4. The switch 5 and actuator projection 5A may be made of plastic. With this construction, the switch 5 is operated by pushing the push button 2 against the elastic force or resiliency of the elastic member 3.

The above conventional switch operating device is not provided with any means for protecting the device against external static electricity. Therefore, when pushing the push button 2 to operate the switch 5, the static electricity charged in the body of the operator is sometimes applied to the printed circuit board 4 thereby destroying the circuit, which is known as a static destroy.

To overcome the above difficulty, as shown in FIGS. 2 and 3, it has been proposed to use leaf springs 6 made of metal instead of the above-mentioned elastic member 3 made of a cushioning material, the lead springs 6 being formed integrally with a frame 8. The frame 8 has a bent portion 8*a* so as to prevent the leaf springs from warping and bending. The The leaf spring 6 serves to produce the required resilient force and also to lead the static electricity to the ground or earth. However, with this construction, the use of the metal leaf springs 6 is indispensable. However, since in fact , a plurality of push buttons 2 are provided on the frame wall 7, it was necessary to prepare many leaf springs. Therefore, the number of component parts is increased. Further, an additional manufacturing operation of shaping the leaf springs 6 to a predetermined configuration is required. This increases the cost of the switch operating device.

SUMMARY OF THE INVENTION

It is therefore an object of this invention to provide a device for protecting an electrical or electronic circuit of electrical equipment against static electricity, which is simple in construction, and can be manufactured at low costs.

According to the present invention, there is provided a static electricity discharging device for a switch operating device, comprising:

(a) a push button operable to move into and out of an operative position where the push button operates the switch of the electrical equipment;

(b) an elastic member normally maintaining the push button out of the operative position, the elastic member being elastically deformable by the push button when the push button is moved to the operative position; and (c) an electrically-conductive layer affixed to a surface of the elastic member, the electrically-conductive layer being held in contact with the push button and being electrically grounded whereby external static electricity applied to the push button is passed to the ground through the electrically-conductive layer.

Thus, the push button is electrically grounded through the electrically-conductive layer, and therefore static electricity will not be passed to an electrical or electronic circuitry of the electrical equipment through the switch, thereby preventing damage to the circuitry. In addition, the device according to the present invention is simple in construction and therefore less costly.

DESCRIPTION OF THE PREFERRED EMBODIMENT OF THE INVENTION

Figure 4:
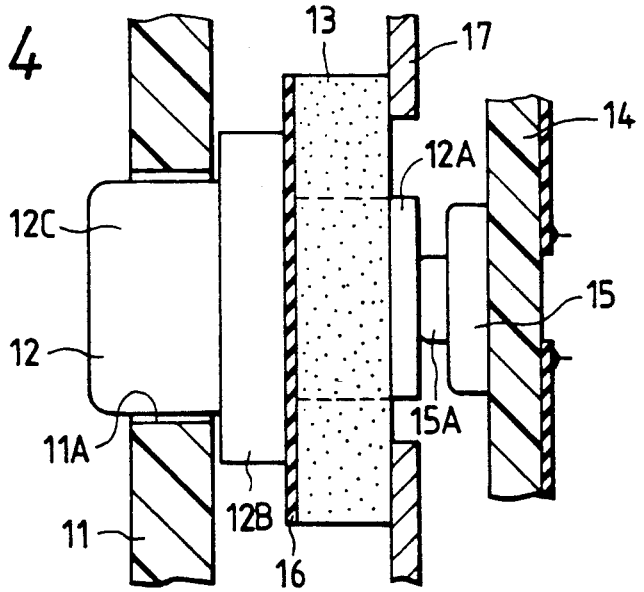
FIG. 4 is a vertical cross-sectional view of a switch operating device of the present invention, shown as incorporated in an electrical equipment.

The invention will now be described with reference to FIGS. 4 and 5.

A switch operating device according to the invention comprises a push button 12 including an elongated body having a flange 12B formed around intermediate opposite ends thereof, a front portion 12C extending forwardly from the flange 12B, and a rear portion 12A extending rearwardly from the flange, the push button 12 being made of plastic. The front portion 12C of the push button 12 extends through an aperture 11A formed through a front panel 11 of electrical equipment such as an amplifier, the front portion 12C projecting outwardly from the front panel 11 so as to be manipulated or pushed by the finger or the like. The push button 12 is movable relative to the front panel 11 along the axis of the push button 12.

Figure 1:
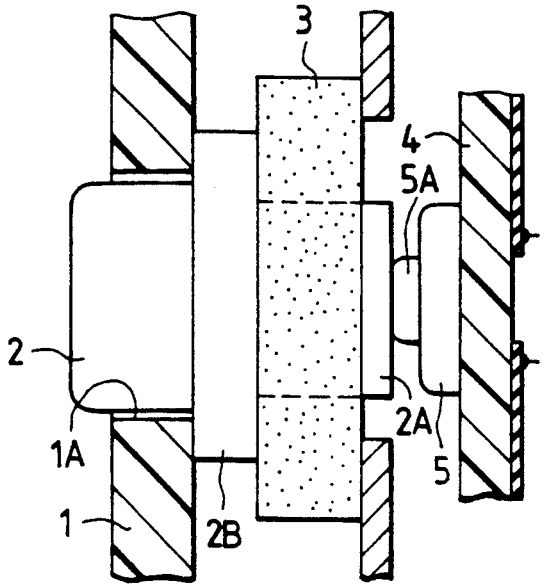
FIG. 1 PRIOR ART
FIG. 1 is a cross-sectional view of a conventional switch operating device.
Figure 2:
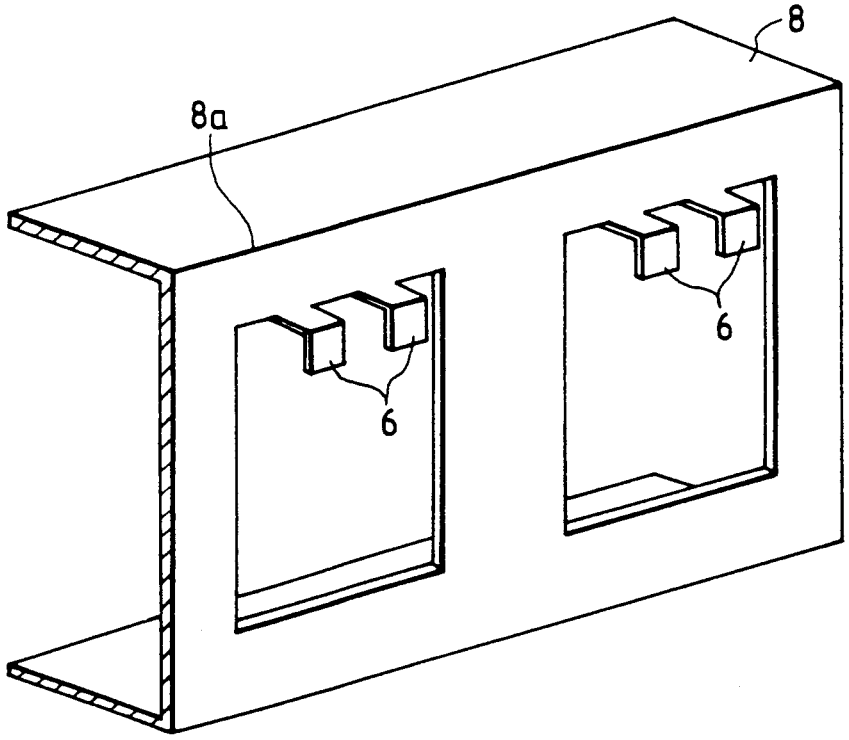
FIG. 2 PRIOR ART
FIG. 2 is a perspective view of a frame with leaf springs used in another conventional switch operating device.
Figure 3:
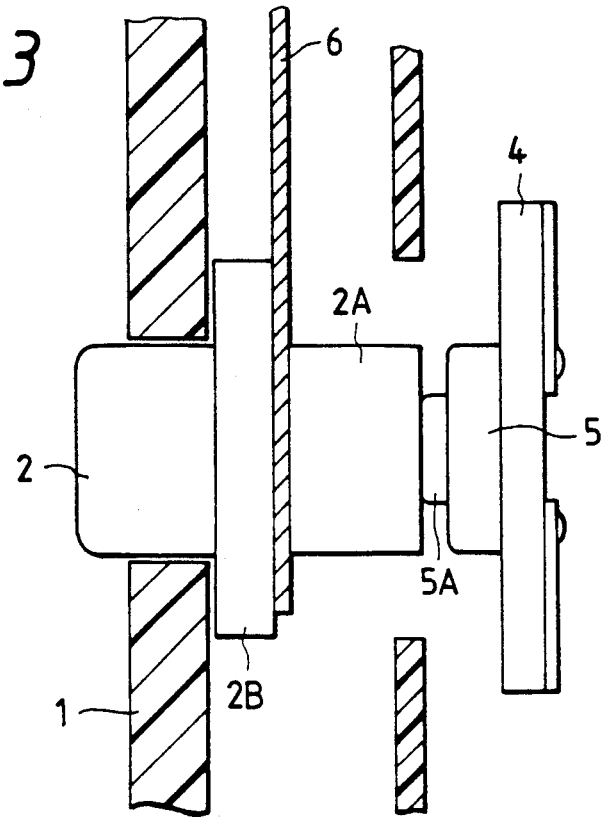
FIG. 3 is a cross-sectional view of a conventional switch operating device using the leaf spring instead of an elastic member shown in FIG. 2.
Figure 5:
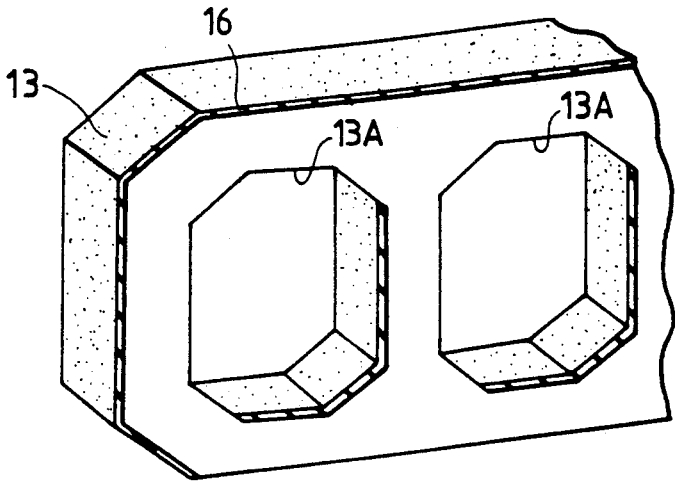
FIG. 5 is a fragmentary perspective view of an elastic member of the device having an electrically-conductive layer thereon.

As shown in FIG. 5, a plate-like elastic member 13 made of a cushioning material has a plurality of apertures 13A formed therethrough. The rear portion 12A of the push button 12 extends through the aperture 13A and is held in contact at its rear face with an actuator projection 15A of a switch 15, the switch 15 being mounted on a printed circuit board 14 of the electrical equipment. The elastic member 13 is interposed between the flange 12B of the push button 12 and a frame wall 17, the frame wall 17 being made of plastic. the flame wall 17 is arranged to hold the elastic member 13, and constituted by a part of a housing. The elastic member 13 normally keeps the push button 12 in its inoperative position (FIG. 3), and is elastically deformed or compressed between the flange 12B and the frame wall 17 when the push button 12 is pushed to its operative position to push the actuator projection 15A of the switch 15 to operate the same.

An electrically-conductive layer 16 is affixed or bonded to one side or face of the elastic member 13 facing the flange 12B of the push button 12, so that the electrically-conductive layer 16 is held in contact with the flange 12B. The electrically-conductive layer 16 is made of a laminate of foils of metal such as iron, and is electrically connected to the ground or earth, such as through the frame or a chassis of the electrical equipment. If the chassis is not near the electrically-conductive layer 16, the latter is connected through a metallic member 19 to the former. The electrically-conductive layer 16 may be attached to any side of the elastic member 13.

In operation, when the push button 12 is pushed toward the printed circuit board 14,by an operator that is, into its operative position, the elastic member 13 having the electrically-conductive layer 16 is compressed between the flange 12B of the push button 12 and the frame wall 17. As a result, the rear face of the rear portion 12A of the push button 12 urges the actuator projection 15A of the switch 15 to thereby operated the switch 15. When the force to push the push button 12 is released, the push button 12 is returned to its initial o inoperative position (FIG. 4) under a restoring force of the compressed elastic member 13. Since the electrically-conductive layer 16, held in contact with the flange 12B of the push button 12, is electrically grounded as described above, external static electricity, charged in the operator who pushed the push button 12, is not passed to the printed circuit board 14, thus ensuring that the electronic elements on the printed circuit board 14 will not be damaged or destroyed.

As described above, by virtue of the provision of the electrically-conductive layer 16 on the one side of the elastic member 13 directed toward the front panel 11, even if the operator charged with static electricity manipulates the push button 12, such external static electricity is positively fed to the ground or earth through the electrically-conductive layer 16 and will not reach the printed circuit board 14, thereby preventing static damage to the electronic elements on the printed circuit board 14. Further, the switch operating device of the present invention is simple in construction and does not require a leaf spring or the like as is the case with the prior art, and therefore the device can be manufactured at lower costs. In the above embodement, the elastic member on one surface of which the electrically-conductive layer is formed is used to keep the push button in its inoperative position. However, such an elastic member having the conductive layer thereon can be also used as a spacer.

Figure 6:
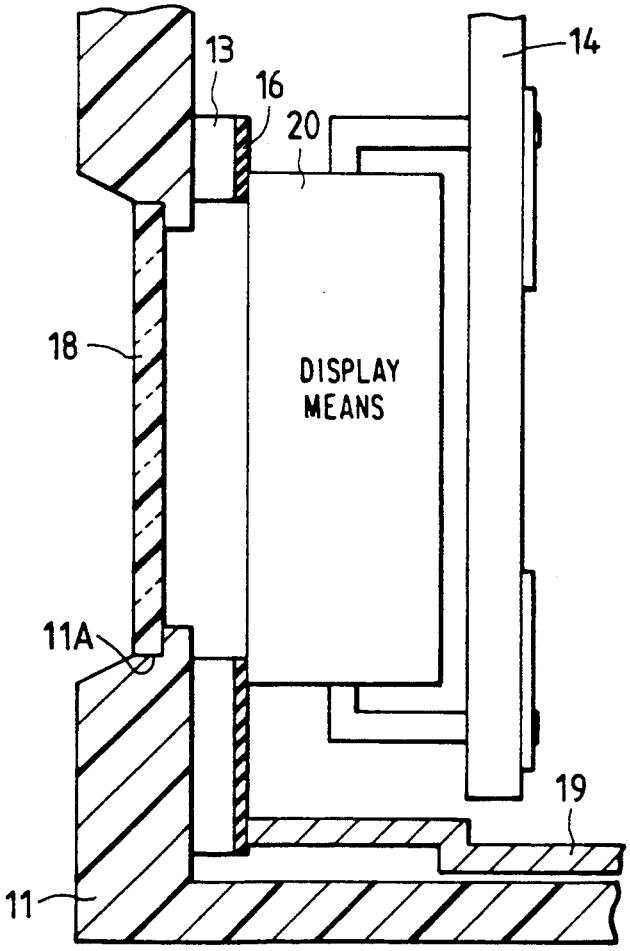
FIG. 6 is a vertical cross-sectional view of a second embodiment of the present invention.

The concept of the present invention is also applicable to a display device shown in FIG. 6.

Referring to FIG. 6, a plate 18 made of transparent material is put in an aperture 11A formed in a front panel 11. An elastic member 13 is interposed as a spacer between the panel 11 and a display unit 20 such as an LCD or FLT so that the elastic member 13 prevents the dusts and the like from entering a space provided between the plate 18 and the display unit 20. An electrically-conductive layer 16 is affixed or bonded to one side or face of the elastic member 13. The electrically-conductive layer 16, as described in the above embodiment, is made of a laminate of foils of metal such as iron, and electrically connected to the ground or earth, such as through the frame of a chassis of the electrical equipment so that external static electricity is positively fed to the ground or earth through electrically-conductive layer 16 and will not reach the display unit 20. Thus, static damage to the electronic elements in the display unit is prevented. Further, the display device of the present invention is simple in construction and therefore can be manufactured at lower costs.

As described above, by virtue of the provision of the electrically-conductive layer on one side of the elastic member, external static electricity charged around the electrical circuit is positively fed to the ground or earth through electrically-conductive layer, but not through the electrical circuit. As a result, static damage to the electronic elements in the electrical circuit is preventable.

What is claimed is:

1. A static electricity discharging device used in a switch for an electrical equipment comprising:

(a) a push button having a body portion penetrating into said electrical equipment and being movable into and out of an operative position so as to operate the switch of the electrical equipment;

(b) an elastic member in mating relationship with said body portion such that said elastic member is maintained in position with respect to said push button, said elastic member normally maintaining said push button out of said operative position, said elastic member being elastically deformable by said push button when said push button is moved to said operative position; and (c) an electrically-conductive layer disposed on a surface of said elastic member and also in mating relation with said body portion, said electrically-conductive layer being electrically grounded whereby external static electricity applied to said push button is passed directly to the ground through said electrically-conductive layer wherein said body portion of said push button includes an elongated body which has a flange formed therearound intermediate opposite ends thereof, a front portion extending forwardly form said flange, and a rear portion extending rearwardly from said flange, said elastic member having an annular shape, said electrically-conductive layer being of an annular shape and being affixed to one side of said elastic member, said rear portion of said push button body extending through said electrically-conductive layer and said elastic member with said electrically-conductive member held in contact with one side of said flange facing away from said front portion of said push button body, and the other side of said elastic member adapted to be mated with a support wall of the electrical equipment.

2. A static electricity discharging device according to claim 1, in which said electrically-conductive layer is made of a laminate of electrically-conductive metal foil.

3. A static electricity discharging device for use in an electrical display device with electrical elements comprising:

a panel;

a transparent plate put in said panel, an area portion of said transparent plate being used as a window for viewing said electrical element;

an elastic member interposed between said panel and said electrical elements in said display device to maintain contact with both said panel and said electrical elements, said elastic member being provided at locations proximate a periphery defined by said area portion; and, an electrically-conductive layer disposed on a surface of said elastic member between said elastic member and said electrical elements, said electrically-conductive layer being electrically grounded whereby external static electricity applied to said transparent plate is passed to the ground through said electrically-conductive layer.

4. A static electricity discharging device according to claim 3, in which said electrically-conductive layer is made of a laminate of electrically-conductive metal foil.

5. A static electricity discharging device used in a switch for electrical equipment comprising:

(a) a push button having a stem portion penetrating into said electrical equipment and being movable into and out of an operative position so as to operate the switch of the electrical equipment;

(b) an annular elastic member disposed in mating relationship to surround said stem portion such that said elastic member is maintained in position with respect to said push button, said elastic member normally maintaining said push button out of said operative position, said elastic member being elastically compressible by said push button when said push button is moved to said operative position; and (c) an annular static-discharging layer disposed on a surface of said elastic member and also in mating relationship to surround said stem portion, said static-discharging layer being electrically conductive and electrically grounded whereby external static electricity applied to said push button is passed directly to the ground through said static-discharging layer.

6. A static electricity discharging device as claimed in claim 5, in which said static-discharging layer is made of a laminate of electrically-conductive metal foil.

7. A static electricity discharging device as claimed in claim 5, in which said push button includes an elongated body which has a flange formed at an intermediate portion thereof, a front portion extending forwardly from said flange, and said stem portion extending rearwardly from aid flange, said static-discharging layer being affixed to one side of said elastic member and being held between said elastic member and one side of said flange.

* * * * *